US007879160B2

(12) United States Patent
Sun

(10) Patent No.: US 7,879,160 B2
(45) Date of Patent: Feb. 1, 2011

(54) COLD ROLLED DUAL-PHASE STEEL SHEET

(75) Inventor: Weiping Sun, Canton, MI (US)

(73) Assignee: Nucor Corporation, Charlotte, NC (US)

( * ) Notice: Subject to any disclaimer, the term of this patent is extended or adjusted under 35 U.S.C. 154(b) by 196 days.

(21) Appl. No.: 12/180,861

(22) Filed: Jul. 28, 2008

(65) Prior Publication Data

US 2008/0289726 A1 Nov. 27, 2008

Related U.S. Application Data

(63) Continuation of application No. 10/997,480, filed on Nov. 24, 2004, now Pat. No. 7,442,268.

(51) Int. Cl.

| | |
|---|---|
| ***C22C 38/18*** | (2006.01) |
| ***C22C 38/38*** | (2006.01) |
| ***C22C 38/20*** | (2006.01) |
| ***C22C 38/26*** | (2006.01) |
| ***C22C 38/24*** | (2006.01) |
| ***C22C 38/28*** | (2006.01) |
| ***C22C 38/40*** | (2006.01) |

(52) U.S. Cl. ..... 148/333; 148/334; 148/335; 148/330

(58) Field of Classification Search ..... 148/333–335, 148/330; 420/104–112

See application file for complete search history.

(56) References Cited

U.S. PATENT DOCUMENTS

| | | | |
|---|---|---|---|
| 3,837,894 | A | 9/1974 | Tucker |
| 4,072,543 | A | 2/1978 | Coldren et al. |
| 4,361,448 | A | 11/1982 | Sippola |
| 4,376,661 | A | 3/1983 | Takechi et al. |
| 4,394,186 | A | 7/1983 | Furukawa |
| 4,398,970 | A | 8/1983 | Marder |
| 4,436,561 | A | 3/1984 | Takahashi et al. |
| 4,437,902 | A | 3/1984 | Pickens et al. |
| 4,609,410 | A | 9/1986 | Hu |
| 4,615,749 | A | 10/1986 | Satoh et al. |
| 4,708,748 | A | 11/1987 | Satoh et al. |

(Continued)

FOREIGN PATENT DOCUMENTS

| | | | |
|---|---|---|---|
| AU | 2005200300 | A1 | 1/2005 |

(Continued)

OTHER PUBLICATIONS

US Steel, Material Safety Data Sheet, Composition TRIP-TEN 780-High Strength Steel, Sep. 1, 1985.*

(Continued)

*Primary Examiner*—Deborah Yee
(74) *Attorney, Agent, or Firm*—Hahn Loeser & Parks LLP

(57) ABSTRACT

A steel sheet having (a) a dual phase microstructure with a martensite phase and a ferrite phase and (b) a composition containing by percent weight: 0.01% to 0.2% C; 0.3% to 3% Mn; 0.05% to 2% Si; 0.1% to 2% Cr; 0.01% to 0.10% Al; and 0.0005% to 0.01% Ca, with the balance of the composition being iron and incidental ingredients. Also, the steel sheet is made by a batch annealing method, and has a tensile strength of at least approximately 400 MPa and an n-value of at least approximately 0.175.

44 Claims, 3 Drawing Sheets

U.S. PATENT DOCUMENTS

| | | | | |
|---|---|---|---|---|
| 4,770,719 | A | | 9/1988 | Hashiguchi et al. |
| 4,854,976 | A | | 8/1989 | Era et al. |
| 5,123,969 | A | * | 6/1992 | Chou ..... 148/547 |
| 5,312,493 | A | | 5/1994 | Masui et al. |
| 5,328,528 | A | | 7/1994 | Chen |
| 5,454,887 | A | | 10/1995 | Fukui |
| 5,470,403 | A | | 11/1995 | Yoshinaga et al. |
| 6,143,100 | A | | 11/2000 | Sun |
| 6,210,496 | B1 | | 4/2001 | Takagi et al. |
| 6,221,179 | B1 | | 4/2001 | Yasuhara et al. |
| 6,312,536 | B1 | | 11/2001 | Omiya |
| 6,423,426 | B1 | | 7/2002 | Kobayashi et al. |
| 6,440,584 | B1 | | 8/2002 | Nagataki et al. |
| 6,537,394 | B1 | | 3/2003 | Osawa et al. |
| 6,641,931 | B2 | | 11/2003 | Claessens |
| 6,666,932 | B2 | | 12/2003 | Funakawa et al. |
| 6,673,171 | B2 | | 1/2004 | Hlady |
| 6,676,774 | B2 | | 1/2004 | Matsuoka et al. |
| 6,702,904 | B2 | | 3/2004 | Kami et al. |
| 6,706,419 | B2 | | 3/2004 | Yoshinaga et al. |
| 6,709,535 | B2 | | 3/2004 | Utsumi et al. |
| 6,726,782 | B2 | | 4/2004 | Nakai et al. |
| 6,811,624 | B2 | | 11/2004 | Hoydick |
| 6,814,819 | B2 | | 11/2004 | Matsuoka et al. |
| 6,818,074 | B2 | | 11/2004 | Matsuoka et al. |
| 6,869,691 | B2 | | 3/2005 | Nagataki et al. |
| 6,982,012 | B2 | | 1/2006 | Nomura et al. |
| 7,090,731 | B2 | | 8/2006 | Kashima et al. |
| 7,118,809 | B2 | | 10/2006 | Utsumi |
| 7,311,789 | B2 | | 12/2007 | Hoydick |
| 7,381,478 | B2 | | 6/2008 | Yokoi et al. |
| 7,396,420 | B2 | | 7/2008 | Matsuoka et al. |
| 7,442,268 | B2 | | 10/2008 | Sun |
| 7,527,700 | B2 | | 5/2009 | Kariya et al. |
| 7,534,312 | B2 | | 5/2009 | Yoshinaga et al. |
| 7,553,380 | B2 | | 6/2009 | Ikeda et al. |
| 7,608,155 | B2 | | 10/2009 | Sun |
| 2003/0041932 | A1 | | 3/2003 | Tosaka et al. |
| 2003/0129444 | A1 | | 7/2003 | Matsuoka |
| 2004/0003774 | A1 | | 1/2004 | Moore |
| 2004/0035500 | A1 | | 2/2004 | Ikeda et al. |
| 2004/0047756 | A1 | | 3/2004 | Rege et al. |
| 2004/0074573 | A1 | | 4/2004 | Funakawa et al. |
| 2004/0118489 | A1 | | 6/2004 | Sun |
| 2004/0238080 | A1 | | 12/2004 | Vandeputte et al. |
| 2004/0238082 | A1 | | 12/2004 | Hasegawa et al. |
| 2005/0016644 | A1 | | 1/2005 | Matsuoka et al. |
| 2005/0019601 | A1 | | 1/2005 | Matsuoka et al. |
| 2006/0144482 | A1 | | 7/2006 | Moulin |
| 2006/0191612 | A1 | | 8/2006 | Yoshida et al. |
| 2007/0003774 | A1 | | 1/2007 | McDaniel |
| 2007/0144633 | A1 | | 6/2007 | Kizu et al. |
| 2009/0071574 | A1 | | 3/2009 | Sun |
| 2009/0071575 | A1 | | 3/2009 | Sun |
| 2009/0242085 | A1 | | 10/2009 | Ikeda et al. |

FOREIGN PATENT DOCUMENTS

| | | | | |
|---|---|---|---|---|
| EP | 0969112 | A1 | | 1/2000 |
| EP | 1191114 | A1 | | 2/2001 |
| EP | 1291448 | A1 | | 3/2003 |
| EP | 1338667 | A1 | | 8/2003 |
| EP | 1431407 | | * | 6/2004 |
| EP | 1666622 | A1 | | 9/2004 |
| JP | 54033218 | | | 3/1979 |
| JP | 55100934 | A | | 8/1980 |
| JP | 56013437 | A | | 2/1981 |
| JP | 58058264 | A | | 4/1983 |
| JP | 08-246097 | | | 9/1996 |
| JP | 10-251794 | | | 9/1998 |
| JP | 2000239791 | A | | 9/2000 |
| JP | 2000336455 | A | | 12/2000 |
| JP | 2001089811 | A | | 4/2001 |
| JP | 2001-220648 | | | 8/2001 |
| WO | 2004059026 | A2 | | 7/2004 |

OTHER PUBLICATIONS

Steel and Heat Treatment, Second Edition, Karl-Erik Thelning, Head of Research and Development Smedjebacken-Boxholm Stal AB, Sweden; Butterworths, printed in Great Britain by Mackagys of Chatham Ltd, Kent; pp. 436-437, 1984.

U.S. Steel—Automotive Center—Comparison of Mechanical Properties; http://www.ussautomotive.com/auto/tech/mech_properties.htm, copyright 2005.

Resistance Spot Welding of Galvanized Steel: Part II. Mechanisms of Spot Weld Nugget Formation; S. A. Gedeon and T. W. Eagar; Metallurgical Transactions B; vol. 17B, Dec. 1986 pp. 887-901; Manuscript submitted Aug. 15, 1985.

Structural Steels; Effect of Alloying Elements and Structure on the Properties of Low-Carbon Heat-Treatable Steel; V. A. Mayshevskii, T. G. Semicheva, and E. I. Khlusova; Translated from Metallovedenie I Termischeskaya Obrabotka Metallov, No. 9, pp. 5-9, Sep. 2001.

What Happens to Steel During Heat Treatment? Part One: Phase Transformations by Daniel H. Herring, Apr. 9, 2007; http://www.industrialheating.com/CDA/Articles/Column/BNP_GUID_9-5-2006_A_1000000000000083813.

http://web.archive.org/web/20050425230953/ussautomotive.com/auto/tech/Grades/TRIP_main.htm, Jul. 12, 2010; US Steel Copyright 2005.

* cited by examiner

COLD ROLLED DUAL-PHASE STEEL SHEET

This application is a continuation of U.S. patent application Ser. No. 10/997,480 filed Nov. 24, 2004, now U.S. Pat. No. 7,442,268, the disclosure of which is expressly incorporated herein by reference.

BACKGROUND AND SUMMARY

The present invention is directed to a dual phase structured (ferrite/martensite) steel sheet product and a method of producing the same. In particular, the steel sheet has an excellent combination of high tensile strength and formability, as determined by the strain hardening exponent, namely the n-value.

The following abbreviations are employed here.

| ABBREVIATIONS | |
|---|---|
| Centigrade | C. |
| compact strip production | CSP |
| degree | ° |
| Fahrenheit | F. |
| mega Pascal | MPa |
| millimeter | mm |
| percent | % |
| second | s |
| weight | wt |

Applications of high strength steel sheets to automotive parts, electric apparatus, building components and machineries are currently increasing. Among these high strength steels, dual phase steel, which possess microstructures of martensite islands embedded in a ferrite matrix, is attracting more and more attention due to such dual phase steel having a superior combination of the properties of high strength, excellent formability, continuous yielding, low yield ratio and/or high work hardening. Particularly with respect to automotive parts, martensite/ferrite dual phase steels, because of these properties, can improve vehicle crashworthiness and durability, and also can be made thin to help to reduce vehicle weight as well. Therefore, martensite/ferrite dual phase steels help to improve vehicle fuel efficiency and vehicle safety.

The previous research and developments in the field of dual phase steel sheets have resulted in several methods for producing dual phase steel sheets, many of which are discussed below.

U.S. Patent Application Publication No. 2003/0084966 A1 to Ikeda et al. discloses a dual phase steel sheet having low yield ratio, and excellence in the balance for strength-elongation and bake hardening properties. The steel contains 0.01-0.20 mass % carbon, 0.5 or less mass % silicon, 0.5-3.0 mass % manganese, 0.06 or less mass % aluminum, 0.15 or less mass % phosphorus, and 0.02 or less mass % sulfur. The method of producing this steel sheet includes hot rolling and continuous annealing or galvanization steps. The hot rolling step includes a step of completing finish rolling at a temperature of ($A_{r3}$-50)° C. [sic, ($A_{r3}$-50)° C.] or higher; and a step of cooling at an average cooling rate of 20° C./s or more down to the Ms point (defined by Ikeda et al. as the matrix phase of tempered martensite) or lower, or to the Ms point or higher and the Bs point (defined by Ikeda et al. as the matrix phase of tempered bainite) or lower, followed by coiling. The continuous annealing step includes a step of heating to a temperature of the $A_1$ point or higher and the $A_3$ point or lower; and a step of cooling at an average cooling rate of 3° C./s or more down to the Ms point or lower; and, optionally, a step of further applying averaging at a temperature from 100 to 600° C.

U.S. Pat. No. 6,440,584 to Nagataki et al. is directed to a hot dip galvanized steel sheet, which is produced by rough rolling a steel, finish rolling the rough rolled steel at a temperature of $A_{r3}$ point or more, coiling the finish rolled steel at a temperature of 700° C. or less, and hot dip galvanizing the coiled steel at a pre-plating heating temperature of $A_{c1}$ to $A_{c3}$. A continuous hot dip galvanizing operation is performed by soaking a pickled strip at a temperature of 750 to 850° C., cooling the soaked strip to a temperature range of 600° C. or less at a cooling rate of 1 to 50° C./s, hot dip galvanizing the cooled strip, and cooling the galvanized strip so that the residence time at 400 to 600° C. is within 200 s.

U.S. Pat. No. 6,423,426 to Kobayashi et al. relates to a high tensile hot dip zinc coated steel plate having a composition comprising 0.05-0.20 mass % carbon, 0.3-1.8 mass % silicon, 1.0-3.0 mass % manganese, and iron as the balance. The steel is subjected to a primary step of primary heat treatment and subsequent rapid cooling to the Ms point or lower, a secondary step of secondary heat treatment and subsequent rapid cooling, and a tertiary step of galvanizing treatment and rapid cooling, so as to obtain 20% or more by volume of tempered martensite in the steel structure.

U.S. Pat. Nos. 4,708,748 (Divisional) and 4,615,749 (Parent), both to Satoh et al., disclose a cold rolled dual phase structure steel sheet, which consists of 0.001-0.008 weight % carbon, not more than 1.0 weight % silicon, 0.05-1.8 weight % manganese, not more than 0.15 weight % phosphorus, 0.01-0.10 weight % aluminum, 0.002-0.050 weight % niobium and 0.0005-0.0050 weight % boron. The steel sheet is manufactured by hot and cold rolling a steel slab with the above chemical composition and continuously annealing the resulting steel sheet in such a manner that the steel sheet is heated and soaked at a temperature from a→γ transformation point to 1000° C. and then cooled at an average rate of not less than 0.5° C./s but less than 20° C./s in a temperature range of from the soaking temperature to 750° C., and subsequently at an average cooling rate of not less than 20° C./s in a temperature range of from 750° C. to not more than 300° C.

The disclosures of all patents and published patent applications, which are mentioned here, are incorporated by reference.

All of the above patents and the above patent publication are related to the manufacture of dual phase steel sheets using a continuous annealing method. Compared to batch annealing, continuous annealing can provide steel sheets which exhibit more uniform mechanical properties. However, the formability and drawability of continuous annealed steel sheets are generally inferior to the formability and drawability of steel sheets produced by batch annealing. A need is thus still called for to develop a new manufacturing method to produce dual phase steel sheets. This appears particularly necessary in North America, where a number of steel manufacturers have no continuous annealing production lines to perform controlled cooling.

The present invention thus has, as a principal object, the provision of a batch annealing method, which typically has less demanding processing requirements than continuous annealing methods, and which advantageously provides a steel sheet that exhibits improvements over the above-described problems of the prior dual phase steel sheet as well as such prior steel sheet having a coating of zinc or a coating of zinc alloy. The batch annealing method should be able to be carried out by most steel manufacturers, using a facility less restrictive than the currently used continuous annealing facilities.

The present invention provides a steel sheet that comprises a dual phase microstructure comprising a martensite phase and a ferrite phase. Also, the steel sheet comprises a composition comprising carbon in a range from about 0.01% by weight to about 0.2% by weight; manganese in a range from about 0.3% by weight to about 3% by weight; silicon in a range from about 0.05% by weight to about 2% by weight; chromium in a range from about 0.1% by weight to about 2% by weight; aluminum in a range from about 0.01% by weight to about 0.10% by weight; and calcium in a range from about 0.0005% by weight to about 0.01% by weight, with the balance of the composition comprising iron and incidental ingredients. Additionally, the steel sheet comprises properties comprising a tensile strength of at least about 400 MPa and an n-value of at least about 0.175.

Furthermore, the present invention provides a steel sheet as described in the paragraph immediately above, where the steel sheet is made by a batch annealing method that comprises: (I) at a temperature in a range between about ($A_{r3}$-60)° C. and about 980° C. (1796° F.), hot rolling a steel slab into a hot band, wherein the steel slab has the composition as described in the paragraph immediately above; (II) cooling the hot band at a mean rate at least about 5° C./s (9° F./s) to a temperature not higher than about 750° C. (1382° F.); (III) coiling the cooled band; (IV) cold rolling the band to a desired steel sheet thickness, with a total reduction of at least about 35%; (V) annealing the cold rolled steel sheet in a batch furnace at a temperature higher than about 500° C. (932° F.) but lower than about the $A_{c3}$ temperature for longer than about 60 minutes; and (VI) cooling the annealed steel sheet to a temperature lower than about 400° C. (752° F.).

Additionally, the present invention provides a batch annealing method of making a steel sheet, comprising: (I) at a temperature in a range between about ($A_{r3}$-60)° C. and about 980° C. (1796° F.), hot rolling a steel slab into a hot band, wherein the steel slab comprises a composition comprising carbon in a range from about 0.01% by weight to about 0.2% by weight; manganese in a range from about 0.3% by weight to about 3% by weight; silicon in a range from about 0.05% by weight to about 2% by weight; chromium in a range from about 0.1% by weight to about 2% by weight; aluminum in a range from about 0.01% by weight to about 0.10% by weight; and calcium in a range from about 0.0005% by weight to about 0.01% by weight, with the balance of the composition comprising iron and incidental ingredients; (II) cooling the hot band at a mean rate at least about 5° C./s (9° F./s) to a temperature not higher than about 750° C. (1382° F.); (III) coiling the cooled band; (IV) cold rolling the band to a desired steel sheet thickness, with a total reduction of at least about 35%; (V) annealing the cold rolled steel sheet in a batch furnace at a temperature higher than about 500° C. (932° F.) and lower than about the $A_{c3}$ temperature for longer than about 60 minutes; (VI) cooling the annealed steel sheet to a temperature lower than about 400° C. (752° F.); and (VII) obtaining a steel sheet comprising (i) a dual phase microstructure comprising a martensite phase and a ferrite phase; (ii) the composition, and (iii) properties comprising a tensile strength of at least about 400 MPa and an n-value of at least about 0.175.

Moreover, the present invention provides a steel sheet that comprises a dual phase microstructure comprising a martensite phase and a ferrite phase, wherein the martensite phase comprises from about 3% by volume to about 35% by volume of the microstructure. Also, the steel sheet comprises a composition comprising carbon in a range from about 0.01% by weight to about 0.2% by weight; manganese in a range from about 0.3% by weight to about 3% by weight; silicon in a range from about 0.05% by weight to about 2% by weight; chromium in a range from about 0.1% by weight to about 2% by weight; aluminum in a range from about 0.01% by weight to about 0.10% by weight; and calcium in a range from about 0.0005% by weight to about 0.01% by weight, with the balance of the composition comprising iron and incidental ingredients. Additionally, the steel sheet comprises properties comprising a tensile strength of at least about 400 MPa, and an n-value of at least about 0.175.

Furthermore, the present invention provides a steel sheet as described in the paragraph immediately above, where the steel sheet is made by a batch annealing method that comprises: (I) at a temperature in a range between about ($A_{r3}$-30)° C. and about 950° C. (1742° F.), hot rolling a steel slab into a hot band, wherein the steel slab has the composition as described in the paragraph immediately above; (II) cooling the hot band at a mean rate at least about 10° C./s (18° F./s) to a temperature not higher than about 650° C. (1202° F.); (III) coiling the cooled band; (IV) cold rolling the band at about ambient temperature to a desired steel sheet thickness, with a total reduction from about 45% to about 85%; (V) annealing the cold rolled steel sheet in a batch furnace to a temperature higher than about 650° C. (1202° F.) but lower than about the $A_{c1}$ temperature for longer than about 60 minutes up to about 8 days; and (VI) cooling the annealed steel sheet to a temperature lower than about 300° C. (57° F.).

Additionally, the present invention provides a batch annealing method of making a steel sheet, comprising: (I) at a temperature in a range between about ($A_{r3}$-30)° C. and about 950° C. (1742° F.), hot rolling a steel slab into a hot band, wherein the steel slab comprises a composition comprising carbon in a range from about 0.01% by weight to about 0.2% by weight; manganese in a range from about 0.3% by weight to about 3% by weight; silicon in a range from about 0.05% by weight to about 2% by weight; chromium in a range from about 0.1% by weight to about 2% by weight; aluminum in a range from about 0.01% by weight to about 0.10% by weight; and calcium in a range from about 0.0005% by weight to about 0.01% by weight, with the balance of the composition comprising iron and incidental ingredients; (II) cooling the hot band at a mean rate at least about 10° C./s (18° F./s) to a temperature not higher than about 650° C. (1202° F.); (III) coiling the cooled band; (IV) cold rolling the band at about ambient temperature to a desired steel sheet thickness, with a total reduction of from about 45% to about 85%; (V) annealing the cold rolled steel sheet in a batch furnace at a temperature higher than about 650° C. (1202° F.) and lower than about the $A_{c1}$ temperature for longer than about 60 minutes up to about 8 days; (VI) cooling the annealed steel sheet to a temperature lower than about 300° C. (572° F.); and (VII) obtaining a steel sheet comprising (i) a dual phase microstructure comprising a martensite phase and a ferrite phase, wherein the martensite phase comprises from about 3% by volume to about 35% by volume of the microstructure; (ii) the composition, and (iii) properties comprising a tensile strength of at least about 400 MPa, an n-value of at least about 0.175.

The invention is now discussed in connection with the accompanying Figures and the Laboratory Examples as best described below.

DETAILED DESCRIPTION OF THE DISCLOSURE

Figure 1:
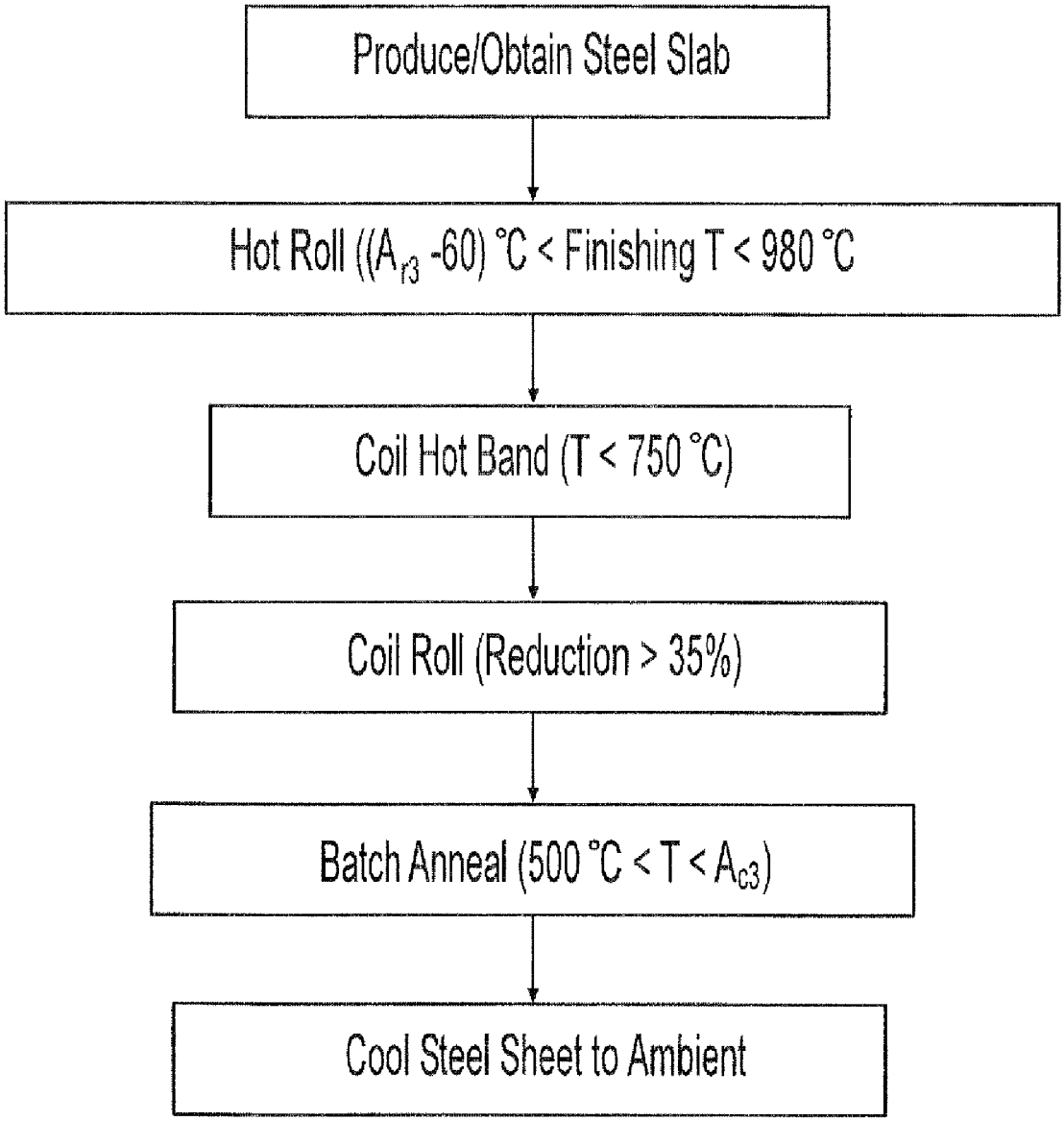
FIG. 1 is a flow chart illustrating an embodiment of the process of the present invention.

The present invention is directed to a cold rolled, low carbon, dual phase steel sheet and a method of making such a steel sheet. The steel sheet exhibits high tensile strength and excellent formability, in that the steel sheet of the present invention has a tensile strength of at least about 400 MPa and an n-value of at least about 0.175. Preferably, the steel sheet of the present invention has a tensile strength of at least about 450 MPa, and an n-value of at least about 0.18. In a preferred embodiment, the steel sheet manufactured according to the present invention possesses a microstructure comprising up to about 35%, more particularly about 3% to about 30% (in volume percentages) tempered martensite islands as a hard second phase embedded in a ferrite matrix phase.

With respect to preferred applications, the inventive steel sheet can be used after being formed (or otherwise press formed) in an "as-cold-rolled" state or optionally can be coated with zinc and/or zinc alloy, for instance, for automobiles, electrical appliances, building components, machineries, and the like.

As described in more detail below, the preferred ranges of various ingredients such as carbon desirably contained in the dual phase steel sheet produced according to the present invention can be readily obtained in the conventional continuous annealing manufacturing process. However, the resultant steel sheet from the conventional continuous annealing manufacturing process will not have the desired properties possessed by the inventive steel sheet of high tensile strength and excellent formability (n-value, namely the strain hardening exponent of the steel sheet).

The preferred ranges for the content of various ingredients such as carbon contained in the steel starting material, which are the same preferred ranges for the content of these various ingredients contained in the composition of the resultant inventive steel sheet, and the reasons for these preferred ranges are as discussed below.

Carbon: Carbon is essential to the hardenability and strength of the steel sheet. Since carbon is necessary in an amount of at least about 0.01% by weight in order to provide necessary strength for the steel sheet, the lower limit of carbon content thus is about 0.01% by weight in the preferred embodiment of the present invention. In order to secure the formation of martensite contributing to the improvement of the strength, however, a more preferable lower limit of carbon is about 0.02% by weight in the present invention. Since a large amount of carbon present in the steel sheet could remarkably deteriorate the formability and weldability, the upper limit of the carbon content in the present invention is thus preferably about 0.2% by weight for an integrated hot mill, and more preferably about 0.12% by weight for hot mills at CSP plants further to assure excellent castability of the steel sheet. Even more particularly, carbon should be present in a range from about 0.03% by weight to about 0.1% by weight.

Manganese: Manganese acts as another alloying factor enhancing the strength of steel sheets and is relatively inexpensive. Since an amount of at least about 0.3% by weight of manganese is necessary in order to ensure the strength and hardenability of the steel sheet, the lower limit of manganese content thus is about 0.3% by weight in the preferred embodiment of the present invention. Furthermore, in order to enhance the stability of austenite and to form at least about 3% by volume of a desired martensite phase in the final steel sheet, the amount of manganese more preferably should be more than about 0.5% by weight. However, when the amount of manganese exceeds about 3% by weight, the weldability of the steel sheet is adversely affected. It is thus of importance for the upper limit of the amount of manganese preferably to be about 3% by weight, more preferably about 2.5% by weight. Even more preferably, manganese should be present in a range from about 0.5% by weight to about 2% by weight.

Silicon: Silicon is useful for increasing the strength but not significantly impairing the ductility or formability of the steel sheet. Moreover, silicon promotes the ferrite transformation and delays the pearlite transformation. Since the steel sheet needs at least about 0.05% by weight of silicon to eliminate effectively pearlite in the ferrite matrix of the final steel sheet, a preferable lower limit of silicon is about 0.05% by weight in the present invention. When the content of silicon exceeds about 2% by weight, the beneficial effect of silicon is saturated and the economical disadvantage is then brought out. Accordingly, the preferred upper limit of silicon content is about 2% by weight. More particularly, silicon should be present in a range from about 0.08% by weight to about 1.5% by weight, and even more particularly, from about 0.1% by weight to about 1.2% by weight.

Chromium: Chromium is effective for improving the hardenability and strength of the steel sheet. Chromium is also useful for stabilizing the remaining austenite and promoting the formation of martensite while having minimal or no adverse effects on austenite to ferrite transformation. In order to assure these effects, the lower limit of chromium content is about 0.1% by weight in the preferred embodiment of the present invention. The upper limit of chromium is preferably about 2% by weight in this invention for maintaining a reasonable manufacturing cost. More particularly, chromium should be present in a range from about 0.2% by weight to about 1.5% by weight, and even more particularly, from about 0.3% by weight to about 1.2% by weight.

Aluminum: Aluminum is employed for deoxidation of the steel and fixing nitrogen, if any, to form aluminum nitrides. Theoretically, the acid-soluble amount of (27/14) N, i.e., 1.9 times the amount of nitrogen, is required to fix nitrogen as aluminum nitrides. Practically, however, the use of at least 0.01% of aluminum by weight is effective as a deoxidation element. Therefore, the lower limit of aluminum content is preferably about 0.01% by weight. When the content of aluminum exceeds about 0.1%, on the other hand, the ductility and formability of the steel sheet are significantly degraded. Hence, the preferred amount of aluminum is not more than about 0.1% by weight. More particularly, aluminum should be present in a range from about 0.015% by weight to about 0.09% by weight, and even more particularly, from about 0.02% by weight to about 0.08% by weight.

Calcium: Calcium is important in the present invention because calcium helps to modify the shape of sulfides, if any. As a result, calcium reduces the harmful effect due to sulfur, if any, and eventually improves the stretch flangeability and fatigue property. Since an amount of at least about 0.0005% by weight is needed to secure this beneficial effect, the lower limit of calcium content is about 0.0005% by weight in the preferred embodiment of the present invention. It is also of note that this beneficial effect is saturated when the amount of calcium exceeds about 0.01% by weight, so that the preferred upper limit of calcium is about 0.01% by weight. More particularly, calcium should be present in a range from about 0.0008% by weight to about 0.009% by weight, and even more particularly, from about 0.001% by weight to about 0.008% by weight.

Various incidental ingredients, such as one or more of phosphorus, sulfur, nitrogen, titanium, vanadium, niobium, boron, molybdenum, copper, and/or nickel may also be present in minor amounts.

Phosphorus: In principle, phosphorus exerts an effect similar to that of manganese and silicon in view of solid solution hardening. When a large amount of phosphorus is added to the steel, however, the castability and rollability of the steel sheet are deteriorated. Besides, the segregation of phosphorus at grain boundaries results in brittleness of the steel sheet, which in turn impairs its formability and weldability. For these reasons, the preferred upper limit of phosphorus content is about 0.1% by weight. More particularly, the upper limit of phosphorus should be about 0.05% by weight, even more particularly, about 0.03% by weight.

Sulfur: Sulfur is not usually added to the steel because a low or no sulfur content is preferable. However, a residual amount of sulfur may be present, depending on the steel making techniques that are employed. Because the inventive steel contains manganese, any residual sulfur typically is precipitated in the form of manganese sulfides. Since a large amount of manganese sulfide precipitate greatly deteriorates the formability and fatigue properties of the steel sheet, the preferred upper limit of sulfur content is accordingly about 0.03% by weight. More particularly, the upper limit of sulfur should be about 0.02% by weight, even more particularly about 0.01% by weight.

Nitrogen: When nitrogen exceeds about 0.02% by weight, the ductility and formability of the steel sheet are significantly reduced, and accordingly, the preferred upper limit of nitrogen content is about 0.02% by weight. More particularly, the upper limit of nitrogen should be about 0.015% by weight, even more particularly about 0.01% by weight.

Titanium, Vanadium and Niobium: Each of titanium, vanadium, or niobium as an alloy can have a strong effect on retarding austenite recrystallization and refining grains. Each of titanium, vanadium, or niobium may be used alone or they may be employed in any combination. When a moderate amount of one or more of them is added, the strength of the final steel sheet is properly increased. They are also useful to accelerate the transformation of austenite to ferrite. However, when the content of each of them exceeds about 0.2% by weight, large amounts of the respective precipitates are formed in the steel sheet. The corresponding precipitation hardening becomes very high, which would reduce castability and rollability during manufacturing the steel sheet, and also deteriorate the formability of the steel sheet when forming or press forming the produced steel sheet into the final parts. It is therefore preferable for the steel sheet to contain any of titanium, vanadium, and/or niobium in an amount no more than about 0.2% by weight. More particularly, the upper limit of each of titanium, vanadium, and/or niobium content should be about 0.15% by weight, more particularly about 0.1% by weight.

Boron: Boron is very effective for improving the hardenability and strength of the steel sheet, even by a small amount. However, when boron is added in excess, the rollability of the steel sheet is significantly lowered. Besides, the segregation of boron at grain boundaries deteriorates the formability. For these reasons, the preferred upper limit of boron content is about 0.008% by weight. More particularly, the upper limit of boron should be about 0.006% by weight, even more particularly about 0.005% by weight. It is possible that no boron is present in the steel sheet.

Molybdenum, Copper and Nickel: Molybdenum, copper, and/or nickel as alloys are also effective for improving the hardenability and strength of the steel sheet. However, excess addition of molybdenum, copper, and/or nickel would result in a saturated effect and deteriorate the surface quality of the steel sheet. Furthermore, they are expensive. Thus, the preferred upper limit for each of them is about 0.8% by weight. More particularly, the upper limit for each of them should be about 0.6% by weight, even more particularly about 0.5% by weight.

Other incidental ingredients: Other incidental ingredients, such as incidental impurities, should be kept to as small a concentration as is practicable in the steel sheet.

By employing a steel starting material falling within the above compositional constraints, the inventive process should have less demanding or restrictive facility and processing requirements. The equipment, particularly the annealing furnace and associated equipment for batch annealing (also known as box annealing), can be far less expensive, as compared with, for example, equipment required for conducting continuous annealing. More particularly, the inventive process can be carried out at most existing CSP mills or carried out at most existing integrated mills without adding substantial additional equipment or capital cost.

A recitation of a preferred embodiment for the inventive process comprises the following steps.

(a) Obtain or produce as a starting material a thin steel slab having a composition within the preferred ranges discussed above, and having a thickness suitable for hot rolling into a hot rolled band, also referred to as a hot rolled steel sheet. A thin slab can be produced from a molten steel having a composition falling within the preferred ranges discussed above by using, for instance, a continuous slab caster or an ingot caster.

(b) Hot roll the steel slab into a hot band and complete the hot rolling process at a temperature in a range between about ($A_{r3}$-60)° C. and about 980° C. (1796° F.), in order to obtain a fine-grained ferrite matrix.

(c) Cool the hot rolled steel, after completing hot rolling, at a mean rate not slower than about 5° C./s (9° F./s).

(d) Coil the hot rolled steel by a coiler, when the hot band has cooled to a temperature not higher than about 750° C. (1382° F.). A conventional coiler may be used.

(e) As an optional step, pickle the above hot rolled coil to improve the surface quality.

(f) Cold roll the hot rolled and optionally pickled coil to a desired steel sheet thickness at a desired time. A conventional cold rolling stand can be used, and typically, cold rolling is performed at about ambient temperature, which usually is about room temperature. The total draft (also known as reduction) should be not less than about 35%.

(g) Batch anneal the cold rolled steel sheet in a batch annealing furnace, the heating being at a temperature higher than about 500° C. (932° F.) but lower than about the $A_{c3}$ temperature. The sheet should be annealed in the furnace for longer than about 60 minutes, typically longer than about 90 minutes, more typically longer than about 180 minutes. The length of the annealing time can vary with the weight of the coil and the size of the furnace, and may be up to about 7 days, or up to about 8 days, or sometimes even longer.

(h) Cool the annealed steel sheet to a temperature lower than about 400° C. (752° F.) to form tempered martensite islands embedded in a ferrite matrix. Since the final product properties in accordance with the present invention are not dependent on the control of specific cooling rates or cooling patterns for the annealed sheet, conventional batch anneal cooling conditions at most existing steel mills are suitable for the process.

(i) If desired, applying a coating, such as a zinc coating and/or a zinc alloy coating, to the steel sheet may be effected. The coating should improve the corrosion resistance of the steel sheet. Further, the "as-cold-rolled" sheet or coated sheet may be formed or press formed into a desired end shape for a final application.

More particularly, the present invention comprises a process for producing a dual phase steel sheet having high tensile strength and excellent formability as follows.

(1) Produce or obtain as a starting material a thin steel slab, preferably with a thickness ranging from about 25 to about 100 mm, for instance using a CSP facility, from steel having a composition including (in weight percentages) about 0.01 to about 0.2% carbon (C), about 0.3 to about 3% manganese (Mn), about 0.05 to about 2% silicon (Si), about 0.1 to about 2% chromium (Cr), not more than about 0.1% phosphorous (P), not more than about 0.03% sulfur (S), not more than about 0.02% nitrogen (N), about 0.01 to about 0.1% aluminum (Al), not more than about 0.2% titanium (Ti), not more than about 0.2% vanadium (V), not more than about 0.2% niobium (Nb), not more than about 0.008% boron (B), not more than about 0.8% molybdenum (Mo), not more than about 0.8% copper (Cu), not more than about 0.8% nickel (Ni), and about 0.0005 to about 0.01% calcium (Ca), the remainder essentially being iron (Fe) and unavoidable impurities.

(2) Hot roll the steel slab to form a hot rolled band and complete the hot rolling process, preferably at a temperature in a range between about ($A_{r3}$-30)° C. and about 950° C. (1742° F.)

(3) Cool the hot rolled steel sheet, preferably immediately after completing hot rolling, preferably at a mean rate not slower than about 10° C./s (18° F./s).

(4) Coil the hot rolled steel by a coiler, preferably starting the coiling process when the hot band has cooled to a temperature not higher than about 650° C. (1202° F.). Starting the coiling when the hot band has cooled to a temperature not higher than about 650° C. (1202° F.) should result in better formability and drawability properties. Typically, the coiling process ends at a temperature much above the ambient temperature.

(5) Pickle the above hot rolled coil, as an optional step, to improve the surface quality.

(6) At ambient temperature, cold roll the hot rolled and optionally pickled coil to a desired thickness, with the total draft (also called reduction) being from about 45% to about 85%.

(7) Transfer the cold rolled steel sheet to a conventional batch annealing furnace (also known as a box annealing furnace), and batch anneal the sheet in the batch furnace, preferably at a temperature higher than about 650° C. (1202° F.) and lower than about the $A_{c1}$ temperature in the subcritical temperature region.

(8) Cool the annealed steel sheet, preferably to a temperature lower than about 300° C. (572° F.). The cooling may be directly to the ambient temperature.

(9) Further, hot dip plating or electroplating may be performed to apply a zinc coating and/or a zinc alloy coating onto the surface of the above cold rolled and annealed steel sheet to improve the corrosion resistance. Either the "as-cold-rolled" sheet or coated sheet may be formed or press formed into the desired end shapes for any final applications.

In the inventive process, a starting material steel slab thicker than about 100 mm may be employed, for instance, about 150 mm, or even thicker, for instance, about 200 mm, or yet thicker, for instance, about 300 mm. Such a thicker steel slab, with the above-noted chemical composition, can be produced in an integrated hot mill by continuous casting or by ingot casting, which thicker slab can also be employed as a starting material. For a thicker slab produced in an integrated mill, a reheating process may be required before conducting the above-mentioned hot rolling operation, by reheating the steel slab to a temperature in a range between about 1050° C. (1922° F.) and about 1350° C. (2462° F.), more typically between about 1100° C. (2012° F.) and about 1300° C. (2372° F.), and then holding at this temperature for a time period of not less than about 10 minutes, more typically not less than about 30 minutes. The reheating helps to assure the uniformity of the initial microstructure of the slabs before conducting a hot rolling process. On the other hand, for a thin slab (under about 100 mm), for instance cast in a CSP plant, the reheating process is usually eliminated.

FIG. 1 is a process flow diagram which illustrates the above-described pertinent process steps of the present invention.

EXAMPLES

Several types of low carbon molten steels were made using an electric arc furnace and were then formed into thin steel sheets with a thickness of about 53 mm at the Nucor-Berkeley compact strip production plant.

Among these steels, DP-1 and DP-2 were steels with compositions according to the present invention and were manufactured according to the process of the present invention. DP-1 had a microstructure with a martensite phase of about 11% by volume. DP-2 had a microstructure with a martensite phase of about 16% by volume.

DP was a comparison steel. The chemical composition of the steel DP also fell within the ranges of the present invention; however, the steel DP was manufactured using a continuous annealing method disclosed in the above-noted prior patents and published patent application. Also, DP was a dual phase steels, having a microstructure with a martensite phase and a ferrite phase, where the martensite phase was within a range from 3 to 35% by volume.

CMn-1 and CMn-2 also were comparison steels. They were conventional low carbon-manganese grades for deep drawing and/or other commercial applications, which were manufactured using a batch annealing method.

HSLA-1 and HSLA-2 also were comparison steels. They were conventional high strength low allow steels, which were also manufactured by a batch annealing method.

More particularly, a steel slab for each of these steels was hot rolled to form hot bands using hot rolling termination temperatures (also called finishing exit temperatures) ranging from 870° C. (1598° F.) to 930° C. (1706° F.). Immediately after hot rolling, the hot rolled steel sheets were water cooled at a conventional runout table at a mean rate of at least about 5° C./s (about 9° F./s) down to the coiling temperatures ranging from 500° C. (932° F.) to 650° C. (1202° F.), and then were coiled at the corresponding temperatures. After hot rolling, the hot bands were pickled to improve surface quality and then cold rolled at ambient temperature to obtain the final thickness of the cold rolled steel sheets ranging from 1.21 mm to 1.57 mm, as noted below in TABLE 2. In the above-mentioned step, the cold reduction was set in a range of 50 to 75%.

Subsequently, the cold rolled steel sheets of DP-1, DP-2, CMn-1, CMn-2, HSLA-1 and HSLA-2 were batch annealed. The batch annealing temperature was set up between 650° C. (1202° F.) and the corresponding $A_{c1}$ temperature based on the present invention. The cold rolled steel sheet of DP was annealed on a continuous annealing line at a temperature between the corresponding $A_{c1}$ and $A_{c3}$ temperatures according to the prior patents.

The following were specific process conditions for DP-1 and DP-2. The hot rolling termination temperature (also called the finishing exit temperature) was 885° C. (1625° F.) for DP-1 and was 877° C. (1610° F.) for DP-2. Cooling the hot rolled steel, after completing hot rolling, was at a mean rate of at least 10° C./s (18° F./s) for both DP-1 and DP-2. The coiling temperature was 591° C. (1095° F.) for DP-1 and was 552° C. (1025° F.) for DP-2. The cold reduction was 68% for both DP-1 and DP-2. The batch annealing temperature at the hot spot (namely, the relatively hot area of the coil during annealing) was 700° C. (1292° F.) for both DP-1 and DP-2. The batch annealing temperature at the cold spot (namely, the relatively cold area of the coil during annealing) was 678° C. (1252° F.) for both DP-1 and DP-2.

The compositions of these various steels are presented below in TABLE 1.

TABLE 1

| | Steel Type (Present Invention) | | Steel Type (Comparisons) | | | | |
|---|---|---|---|---|---|---|---|
| | DP-1 | DP-2 | DP | CMn-1 | CMn-2 | HSLA-1 | HSLA-2 |
| Method of annealing | batch | batch | continuous | batch | batch | batch | batch |
| Starting Thickness (mm) | 53 | 53 | 53 | 53 | 53 | 53 | 53 |
| C (wt %) | 0.039 | 0.046 | 0.045 | 0.018 | 0.041 | 0.043 | 0.050 |
| Mn (wt %) | 1.632 | 1.568 | 1.596 | 0.178 | 0.273 | 0.797 | 1.305 |
| Si (wt %) | 0.335 | 0.962 | 0.200 | 0.034 | 0.022 | 0.024 | 0.030 |
| P (wt %) | 0.024 | 0.022 | 0.015 | 0.005 | 0.009 | 0.041 | 0.010 |
| S (wt %) | 0.001 | 0.002 | 0.002 | 0.004 | 0.002 | 0.005 | 0.005 |
| Al (wt %) | 0.050 | 0.039 | 0.042 | 0.047 | 0.035 | 0.032 | 0.025 |
| Ca (wt %) | 0.0027 | 0.0032 | 0.0036 | trace | trace | trace | trace |
| Cr (wt %) | 0.911 | 0.821 | 0.785 | 0.020 | 0.036 | 0.052 | 0.038 |
| Nb (wt %) | 0.006 | 0.006 | 0.006 | 0.002 | 0.002 | 0.029 | 0.006 |
| V (wt %) | 0.010 | 0.002 | 0.008 | trace | trace | 0.004 | 0.020 |

Test pieces were taken from the resulting cold rolled and annealed steel sheets, and were machined into tensile specimens in the longitudinal direction, namely along the hot rolling direction, for testing of the respective mechanical properties of the various steel sheets.

Tensile testing was conducted in accordance with the standard ASTM A370 method to measure the corresponding mechanical properties, including yield strength, tensile strength, and total elongation. The strain hardening exponent, known as the n-value, was determined in accordance with the ASTM E646 method by the slope of the "best fit line" between 10% and 20% strain.

The test data obtained are presented below in TABLE 2.

TABLE 2

| | Steel Type (Present Invention) | | Steel Type (Comparisons) | | | | |
|---|---|---|---|---|---|---|---|
| | DP-1 | DP-2 | DP | CMn-1 | CMn-2 | HSLA-1 | HSLA-2 |
| Method of annealing | batch | batch | continuous | batch | batch | batch | batch |
| Test thickness (mm) | 1.57 | 1.21 | 1.47 | 1.45 | 1.52 | 1.35 | 1.45 |
| Yield strength (MPa) | 306 | 398 | 411 | 196 | 235 | 348 | 387 |
| Tensile strength (MPa) | 465 | 538 | 618 | 308 | 351 | 475 | 478 |
| Total elongation (%) | 28 | 28 | 22 | 41 | 35 | 26 | 26 |
| n-value (10% to 20%) | 0.204 | 0.202 | 0.159 | 0.210 | 0.101 | 0.173 | 0.156 |

As can be seen from TABLE 2, batch annealed dual phase steels according to the present invention (DP-1 and DP-2) demonstrated higher total elongation and n-value than continuous annealed dual phase steels (DP).

Additionally, batch annealed dual phase steels according to the present invention (DP-1 and DP-2) had higher yield strength and tensile strength than conventional batch annealed low carbon-manganese steels (CMn-1 and CMn-2).

Also, batch annealed dual phase steels according to the present invention (DP-1 and DP-2) demonstrated higher total elongation and n-value than conventional batch annealed high strength low alloy steels (HSLA-1 and HSLA-2).

Figure 2:
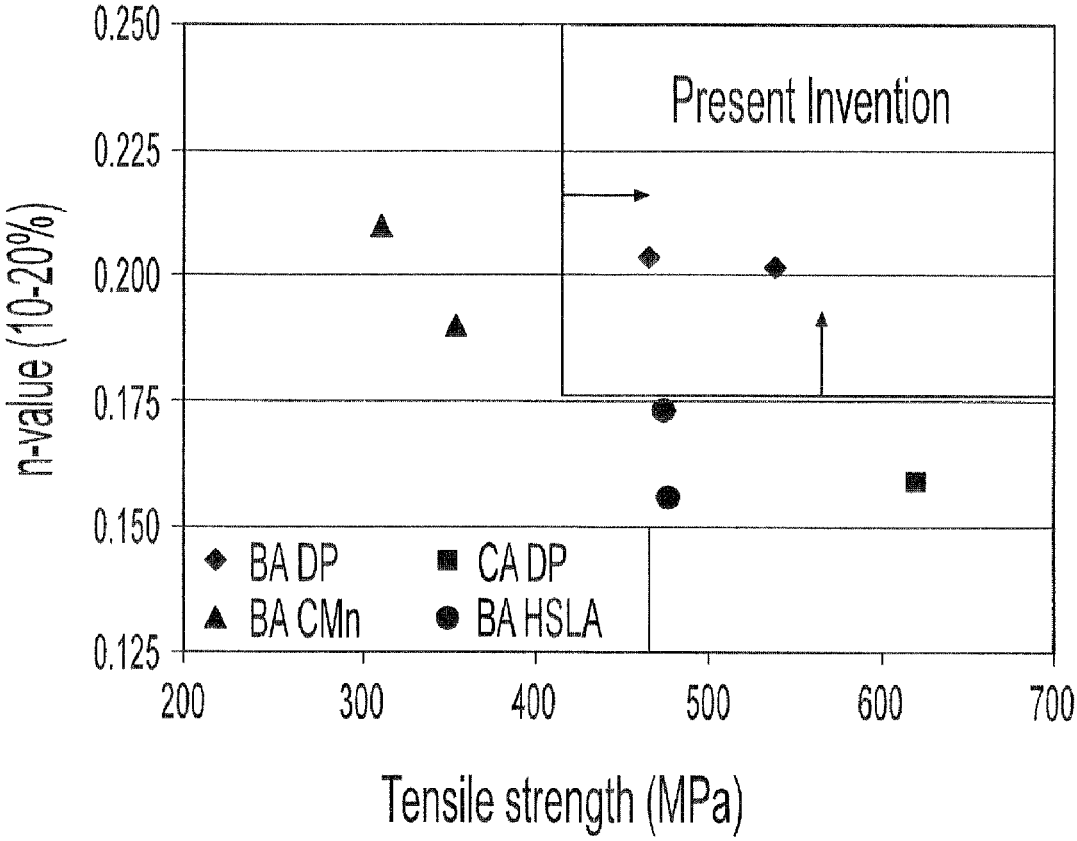
FIG. 2 is a graph of the tensile strength versus the n-value for certain embodiments of steel sheet in accordance with the present invention as compared to those properties of various comparison steel sheets.

Since the n-value is a property parameter mostly used to evaluate the formability of a steel sheet, the obtained values of this parameter for the above steels are also presented in the graph of FIG. 2 as a function of tensile strength. As shown in this graph, the dual phase steel sheets manufactured according to the present invention exhibited a superior combination of strength and formability, and thus provided a much higher strength level with a similar formability compared to batch annealed low carbon-manganese, and a comparable strength level but a much improved formability compared to conventional batch annealed high strength low alloy steels as well as continuous annealed dual phase steels.

Figure 3:
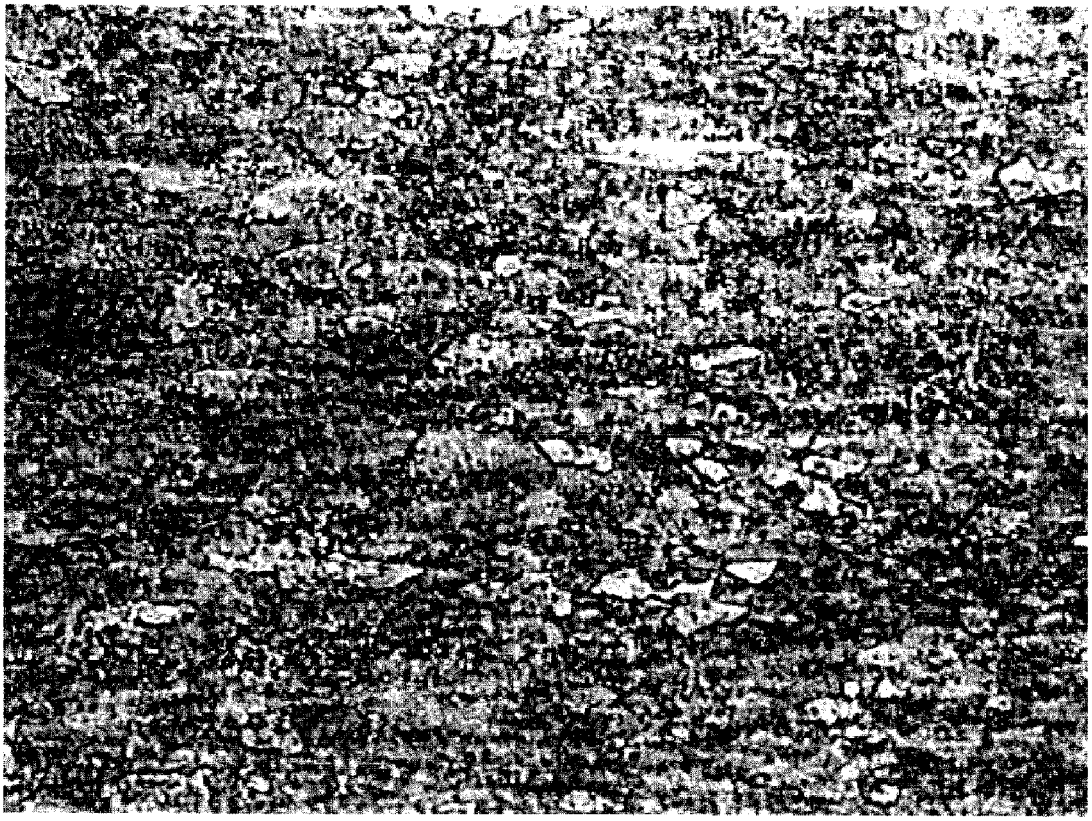
FIG. 3 is a photograph taken through a microscope of one embodiment of a steel sheet in accordance with the present invention.

Finally, the microstructure of the cold rolled steel sheets of the present invention was examined. One of the typical micrographs obtained using a Nikon Epiphot 200 Microscope is given in FIG. 3. As illustrated by this micrograph, martensite islands are uniformly distributed in the ferrite matrix. It is such a dual phase structure that provides the excellent combination of strength and formability for the presently invented steel sheet.

Although the present invention has been shown and described in detail with regard to only a few exemplary embodiments of the invention, it should be understood by those skilled in the art that it is not intended to limit the invention to specific embodiments disclosed. Various modifications, omissions, and additions may be made to the disclosed embodiments without materially departing from the novel teachings and advantages of the invention, particularly in light of the foregoing teachings. Accordingly, it is intended to cover all such modifications, omissions, additions, and equivalents as may be included within the spirit and scope of the invention as defined by the following claims.

What is claimed is:

1. A steel sheet having been subjected to cold rolling and batch annealing comprising:

(a) a dual phase microstructure comprising a tempered martensite phase no more than about 35% by volume embedded in a ferrite matrix phase before cold rolling and batch annealing;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of the composition comprising iron and incidental ingredients; and (c) properties comprising a tensile strength of at least about 400 MPa and an n-value of at least about 0.175 after cold rolling and batch annealing lower than about the $A_{c1}$ temperature.

2. The steel sheet of claim 1, wherein the properties comprise a tensile strength of about least about 450 MPa, and an n-value of at least about 0.18.

3. The steel sheet of claim 1, wherein the martensite phase comprises from about 3% by volume to about 30% by volume of the microstructure.

4. The steel sheet of claim 1, wherein the composition further comprises one or more of titanium in an amount up to about 0.2% by weight; vanadium in an amount up to about 0.2% by weight; niobium in an amount up to about 0.2% by weight; boron in an amount up to about 0.008% by weight; molybdenum in an amount up to about 0.8% by weight; copper in an amount up to about 0.8% by weight; nickel in an amount up to about 0.8% by weight; phosphorous in an amount up to about 0.1% by weight; sulfur in an amount up to about 0.03% by weight; and nitrogen in an amount up to about 0.02% by weight.

5. The steel sheet of claim 1, wherein the steel sheet further comprises one or both of a zinc coating or a zinc alloy coating.

6. The steel sheet of claim 1, wherein the carbon ranges from about 0.02% to about 0.12% by weight, the manganese ranges from about 0.5% to about 2.5% by weight, the silicon ranges from about 0.08% to about 1.5% by weight, the chromium ranges from about 0.2% to about 1.5% by weight, the aluminum ranges from about 0.015% to about 0.09% by weight, the calcium ranges from about 0.0008% to about 0.009% by weight, or a combination thereof.

7. The steel sheet of claim 6, wherein the carbon ranges from about 0.03% to about 0.1% by weight, the manganese ranges from about 0.5% to about 2% by weight, the silicon ranges from about 0.1% to about 1.2% by weight, the chromium ranges from about 0.3% to about 1.2% by weight, the aluminum ranges from about 0.02% to about 0.08% by weight, the calcium ranges from about 0.001% to about 0.008% by weight, or a combination thereof.

8. A steel sheet comprising:

(a) a dual phase microstructure comprising a tempered martensite phase and a ferrite phase;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of said composition comprising iron and incidental ingredients; and (c) properties comprising a tensile strength of at least about 400 MPa and an n-value of at least about 0.175;

and wherein the steel sheet is made by a batch annealing method comprising:

(I) hot rolling a steel slab having said composition into a hot band and complete the hot rolling process at a temperature in a range between about ($A_{r3}$-60)° C. and about 980° C. (about 1796° F.);

(II) cooling the hot band at a mean rate of at least about 5° C./s (about 9° F./s) to a temperature not higher than about 750° C. (about 1382° F.) obtaining a steel sheet comprising a dual phase microstructure comprising a martensite phase up to about 35% by volume and a ferrite phase at least 65% by volume;

(III) coiling the cooled band to form a coil;

(IV) cold rolling the coil to a desired steel sheet thickness, with a total reduction of at least about 35%;

(V) annealing the cold rolled steel sheet in a batch furnace at a temperature higher than about 500° C. (about 932° F.) but lower than about the $A_{c1}$ temperature for longer than about 60 minutes; and (VI) cooling the annealed steel sheet to a temperature lower than about 400° C. (about 752° F.).

9. The steel sheet of claim 8, wherein the properties comprise a tensile strength of about least about 450 MPa, and an n-value of at least about 0.18.

10. The steel sheet of claim 8, wherein the martensite phase comprises from about 3% by volume to about 30% by volume of the microstructure.

11. The steel sheet of claim 8, wherein the composition further comprises one or more of titanium in an amount up to about 0.2% by weight; vanadium in an amount up to about 0.2% by weight; niobium in an amount up to about 0.2% by weight; boron in an amount up to about 0.008% by weight; molybdenum in an amount up to about 0.8% by weight; copper in an amount up to about 0.8% by weight; nickel in an amount up to about 0.8% by weight; phosphorous in an amount up to about 0.1% by weight; sulfur in an amount up to about 0.03% by weight; or nitrogen in an amount up to about 0.02% by weight.

12. The steel sheet of claim 8, wherein the steel sheet further comprises one or both of a zinc coating or a zinc alloy coating.

13. The steel sheet of claim 8, wherein the carbon ranges from about 0.02% to about 0.12% by weight, the manganese ranges from about 0.5% to about 2.5% by weight, the silicon ranges from about 0.08% to about 1.5% by weight, the chromium ranges from about 0.2% to about 1.5% by weight, the aluminum ranges from about 0.015% to about 0.09% by weight, the calcium ranges from about 0.0008% to about 0.009% by weight, or a combination thereof.

14. The steel sheet of claim 13, wherein the carbon ranges from about 0.03% to about 0.1% by weight, the manganese ranges from about 0.5% to about 2% by weight, the silicon ranges from about 0.1% to about 1.2% by weight, the chromium ranges from about 0.3% to about 1.2% by weight, the aluminum ranges from about 0.02% to about 0.08% by weight, the calcium ranges from about 0.001% to about 0.008% by weight, or a combination thereof.

15. The steel sheet of claim 8, wherein complete the hot rolling process at a temperature in a range between about ($A_{r3}$-30)° C. and about 950° C. (about 1742° F.).

16. The steel sheet of claim 8, wherein cooling the hot band is at a mean rate of at least about 10° C./s (about 18° F./s) to a temperature not higher than about 650° C. (about 1202° F.).

17. The steel sheet of claim 8, wherein the coil is pickled.

18. The steel sheet of claim 8, wherein the total reduction ranges from about 45% to about 85%.

19. The steel sheet of claim 8, wherein the annealing is a temperature higher than about 500° C. (about 932° F.) and lower than about the $A_{c1}$ temperature in the subcritical temperature region for a time from about 180 minutes to about 7 days.

20. The steel sheet of claim 8, wherein cooling the annealed sheet is to a temperature from about 300° C. (about 572° F.) to about ambient temperature.

21. A steel sheet having been subjected to cold rolling and batch annealing comprising:

(a) a dual phase microstructure comprising a tempered martensite phase embedded in a ferrite matrix phase, wherein the martensite phase comprises from about 3% by volume to about 35% by volume of the microstructure and the ferrite phase comprises at least 65% by volume before cold rolling and batch annealing;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of the composition comprising iron and incidental ingredients; and (c) properties comprising a tensile strength of at least about 400 MPa, and an n-value of at least about 0.175 after cold rolling and batch annealing lower than about the $A_{c1}$ temperature.

22. A steel sheet comprising:

(a) a dual phase microstructure comprising a tempered martensite phase embedded in a ferrite matrix phase, wherein the martensite phase comprises from about 3% by volume to about 35% by volume and the ferrite phase comprises at least 65% by volume of the microstructure before cold rolling and batch annealing;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1° A) by weight to about 2% by weight, aluminum in a range from about 0.01% by weight to about 0.10% by weight, and calcium in a range from about 0.0005% by weight to about 0.01% by weight, with the balance of said composition comprising iron and incidental ingredients; and (c) properties comprising a tensile strength of at least about 400 MPa, and an n-value of at least about 0.175 after cold rolling and batch annealing lower than about the $A_{c1}$ temperature;

and wherein the steel sheet is made by a batch annealing method comprising:

(I) hot rolling a steel slab having said composition into a hot band and complete the hot rolling process at a temperature in a range between about ($A_{r3}$-30)° C. and about 950° C. (about 1742° F.);

(II) cooling the hot band at a mean rate of at least about 10° C./s (about 18° F./s) to a temperature not higher than about 650° C. (about 1202° F.);

(III) coiling the cooled band to form a coil;

(IV) cold rolling the coil at about ambient temperature to a desired steel sheet thickness, with a total reduction ranging from about 45% to about 85%;

(V) annealing the cold rolled steel sheet in a batch furnace to a temperature higher than about 650° C. (about 1202° F.) but lower than about the $A_{c1}$ temperature for longer than about 60 minutes; and (VI) cooling the annealed steel sheet to a temperature lower than about 300° C. (about 572° F.).

23. A steel sheet having been subjected to cold rolling and batch annealing comprising:

(a) a dual phase microstructure comprising a tempered martensite phase no more than about 35% by volume embedded in a ferrite matrix phase;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of the composition comprising iron and incidental ingredients; and (c) properties comprising a tensile strength of at least about 400 MPa and an n-value of at least about 0.175 after cold rolling and batch annealing.

24. The steel sheet of claim 23, wherein the properties comprise a tensile strength of about least about 450 MPa, and an n-value of at least about 0.18.

25. The steel sheet of claim 23, wherein the martensite phase comprises from about 3% by volume to about 30% by volume of the microstructure.

26. The steel sheet of claim 23, wherein the composition further comprises one or more of titanium in an amount up to about 0.2% by weight; vanadium in an amount up to about 0.2% by weight; niobium in an amount up to about 0.2% by weight; boron in an amount up to about 0.008% by weight; molybdenum in an amount up to about 0.8% by weight; copper in an amount up to about 0.8% by weight; nickel in an amount up to about 0.8% by weight; phosphorous in an amount up to about 0.1% by weight; sulfur in an amount up to about 0.03% by weight; and nitrogen in an amount up to about 0.02% by weight.

27. The steel sheet of claim 23, wherein the steel sheet further comprises one or both of a zinc coating or a zinc alloy coating.

28. The steel sheet of claim 23, wherein the carbon ranges from about 0.02% to about 0.12% by weight, the manganese ranges from about 0.5% to about 2.5% by weight, the silicon ranges from about 0.08% to about 1.5% by weight, the chromium ranges from about 0.2% to about 1.5% by weight, the aluminum ranges from about 0.015% to about 0.09% by weight, the calcium ranges from about 0.0008% to about 0.009% by weight, or a combination thereof.

29. The steel sheet of claim 28, wherein the carbon ranges from about 0.03% to about 0.1% by weight, the manganese ranges from about 0.5% to about 2% by weight, the silicon ranges from about 0.1% to about 1.2% by weight, the chromium ranges from about 0.3% to about 1.2% by weight, the aluminum ranges from about 0.02% to about 0.08% by weight, the calcium ranges from about 0.001% to about 0.008% by weight, or a combination thereof.

30. A steel sheet comprising:

(a) a dual phase microstructure comprising a tempered martensite phase and a ferrite phase;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of said composition comprising iron and incidental ingredients; and (c) properties comprising a tensile strength of at least about 400 MPa and an n-value of at least about 0.175;

and wherein the steel sheet is made by a batch annealing method comprising:

(I) hot rolling a steel slab having said composition into a hot band and complete the hot rolling process at a temperature in a range between about ($A_{r3}$-60)° C. and about 980° C. (about 1796° F.);

(II) cooling the hot band at a mean rate of at least about 5° C./s (about 9° F./s) to a temperature not higher than about 750° C. (about 1382° F.) obtaining a steel sheet comprising a dual phase microstructure comprising a martensite phase up to about 35% by volume and a ferrite phase at least 65% by volume;

(III) coiling the cooled band to form a coil;

(IV) cold rolling the coil to a desired steel sheet thickness, with a total reduction of at least about 35%;

(V) annealing the cold rolled steel sheet in a batch furnace at a temperature higher than about 500° C. (about 932° F.) but lower than about the $A_{c3}$ temperature for longer than about 60 minutes; and (VI) cooling the annealed steel sheet to a temperature lower than about 400° C. (about 752° F.).

31. The steel sheet of claim 30, wherein the properties comprise a tensile strength of about least about 450 MPa, and an n-value of at least about 0.18.

32. The steel sheet of claim 30, wherein the martensite phase comprises from about 3% by volume to about 30% by volume of the microstructure.

33. The steel sheet of claim 30, wherein the composition further comprises one or more of titanium in an amount up to about 0.2% by weight; vanadium in an amount up to about 0.2% by weight; niobium in an amount up to about 0.2% by weight; boron in an amount up to about 0.008% by weight; molybdenum in an amount up to about 0.8% by weight; copper in an amount up to about 0.8% by weight; nickel in an amount up to about 0.8% by weight; phosphorous in an amount up to about 0.1% by weight; sulfur in an amount up to about 0.03% by weight; or nitrogen in an amount up to about 0.02% by weight.

34. The steel sheet of claim 30, wherein the steel sheet further comprises one or both of a zinc coating or a zinc alloy coating.

35. The steel sheet of claim 30, wherein the carbon ranges from about 0.02% to about 0.12% by weight, the manganese ranges from about 0.5% to about 2.5% by weight, the silicon ranges from about 0.08% to about 1.5% by weight, the chromium ranges from about 0.2% to about 1.5% by weight, the aluminum ranges from about 0.015% to about 0.09% by weight, the calcium ranges from about 0.0008% to about 0.009% by weight, or a combination thereof.

36. The steel sheet of claim 35, wherein the carbon ranges from about 0.03% to about 0.1% by weight, the manganese ranges from about 0.5% to about 2% by weight, the silicon ranges from about 0.1% to about 1.2% by weight, the chromium ranges from about 0.3% to about 1.2% by weight, the aluminum ranges from about 0.02% to about 0.08% by weight, the calcium ranges from about 0.001% to about 0.008% by weight, or a combination thereof.

37. The steel sheet of claim 30, wherein complete the hot rolling process at a temperature in a range between about ($A_{r3}$-30)° C. and about 950° C. (about 1742° F.).

38. The steel sheet of claim 30, wherein cooling the hot band is at a mean rate of at least about 10° C./s (about 18° F./s) to a temperature not higher than about 650° C. (about 1202° F.).

39. The steel sheet of claim 30, wherein the coil is pickled.

40. The steel sheet of claim 30, wherein the total reduction ranges from about 45% to about 85%.

41. The steel sheet of claim 30, wherein the annealing is a temperature higher than about 500° C. (about 932° F.) and lower than about the $A_{c1}$ temperature in the subcritical temperature region for a time from about 180 minutes to about 7 days.

42. The steel sheet of claim 30, wherein cooling the annealed sheet is to a temperature from about 300° C. (about 572° F.) to about ambient temperature.

43. A steel sheet having been subjected to cold rolling and batch annealing comprising:

(a) a dual phase microstructure comprising a tempered martensite phase embedded in a ferrite matrix phase, wherein the tempered martensite phase comprises from about 3% by volume to about 35% by volume of the microstructure and the ferrite phase comprises at least 65% by volume;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of the composition comprising iron and incidental ingredients; and (c) properties comprising a tensile strength of at least about 400 MPa, and an n-value of at least about 0.175 after cold rolling and batch annealing.

44. A steel sheet comprising:

(a) a dual phase microstructure comprising a tempered martensite phase embedded in a ferrite matrix phase, wherein the martensite phase comprises from about 3% by volume to about 35% by volume and the ferrite phase comprises at least 65% by volume of the microstructure;

(b) a composition comprising:

carbon in a range from about 0.01% by weight to about 0.2% by weight, manganese in a range from about 0.3% by weight to about 3% by weight, silicon in a range from about 0.05% by weight to about 2% by weight, chromium in a range from about 0.1% by weight to about 2% by weight, aluminum in a range from about 0.01% by weight to about 0.10% by weight, and calcium in a range from about 0.0005% by weight to about 0.01% by weight, with the balance of said composition comprising iron and incidental ingredients; and (c) properties comprising a tensile strength of at least about 400 MPa, and an n-value of at least about 0.175 after cold rolling and batch annealing;

and wherein the steel sheet is made by a batch annealing method comprising:

(I) hot rolling a steel slab having said composition into a hot band and complete the hot rolling process at a temperature in a range between about ($A_{r3}$-30)° C. and about 950° C. (about 1742° F.);

(II) cooling the hot band at a mean rate of at least about 10° C./s (about 18° F./s) to a temperature not higher than about 650° C. (about 1202° F.);

(III) coiling the cooled band to form a coil;

(IV) cold rolling the coil at about ambient temperature to a desired steel sheet thickness, with a total reduction ranging from about 45% to about 85%;

(V) annealing the cold rolled steel sheet in a batch furnace to a temperature higher than about 650° C. (about 1202° F.) but lower than about the $A_{c3}$ temperature for longer than about 60 minutes; and (VI) cooling the annealed steel sheet to a temperature lower than about 300° C. (about 572° F.).

* * * * *